US007740521B2

(12) United States Patent
Hashimoto et al.

(10) Patent No.: US 7,740,521 B2
(45) Date of Patent: Jun. 22, 2010

(54) POLISHING HEAD, POLISHING APPARATUS AND POLISHING METHOD FOR SEMICONDUCTOR WAFER

(75) Inventors: Hiromasa Hashimoto, Fukushima (JP); Yasuharu Ariga, Fukushima (JP); Hisashi Masumura, Fukushima (JP); Kouzi Kitagawa, Fukushima (JP); Toshimasa Kubota, Tokyo (JP); Takahiro Matsuda, Fukui (JP)

(73) Assignee: Shin-Etsu-Handotai Co., Ltd., Tokyo (JP)

( * ) Notice: Subject to any disclaimer, the term of this patent is extended or adjusted under 35 U.S.C. 154(b) by 61 days.

(21) Appl. No.: 11/884,833

(22) PCT Filed: Mar. 1, 2006

(86) PCT No.: PCT/JP2006/303835

§ 371 (c)(1),
(2), (4) Date: Aug. 22, 2007

(87) PCT Pub. No.: WO2006/098150

PCT Pub. Date: Sep. 21, 2006

(65) Prior Publication Data

US 2008/0254720 A1 Oct. 16, 2008

(30) Foreign Application Priority Data

Mar. 14, 2005 (JP) ..... 2005-070826

(51) Int. Cl.
*B24B 1/00* (2006.01)
*B24B 21/18* (2006.01)

(52) U.S. Cl. ..... 451/41; 451/59; 451/60; 451/63; 451/72; 451/289; 451/398; 451/443

(58) Field of Classification Search ..... 216/88, 216/89; 438/692, 693; 451/36, 41, 59, 60, 451/63, 72, 285, 288, 289, 290, 398, 443
See application file for complete search history.

(56) References Cited

U.S. PATENT DOCUMENTS 5,857,899 A * 1/1999 Volodarsky et al. ..... 451/72

(Continued)

FOREIGN PATENT DOCUMENTS

EP 1 582 293 A 10/2005

(Continued)

*Primary Examiner*—Timothy V Eley
(74) *Attorney, Agent, or Firm*—Oliff & Berridge, PLC

(57) ABSTRACT

The present invention provides a polishing head 1 comprising a carrier 3, a guide ring 4, a dress ring 5, and a head body 2, wherein the head body 2 is rotatable, and holds the carrier 3, the guide ring 4, and the dress ring 5; the head body 2 has a reversed-bowl shape and has a hollow 8; the dress ring, and at least the guide ring or the carrier are held by being coupled to a lower brim of the head body via a diaphragm 6; the hollow of the head body is sealed. During polishing, the pressure of the sealed hollow is adjusted with a pressure regulating mechanism 9 communicating with the hollow, thereby elastically deforming the diaphragm. As a result, a wafer W can be polished while the wafer and the dress ring are pressed with a given pressing force against a polishing pad 11 on a turn table 12 with rotating the wafer held by the carrier and the dress ring. Consequently, there is provided a polishing head or the like with which excessive polishing in the outer periphery of a semiconductor wafer can be prevented and generation of impressions or scratches in the edge portion of the wafer can be prevented effectively.

10 Claims, 10 Drawing Sheets

U.S. PATENT DOCUMENTS

| | | | | |
|---|---|---|---|---|
| 6,196,905 | B1 * | 3/2001 | Inaba | 451/288 |
| 6,203,414 | B1 * | 3/2001 | Numoto et al. | 451/288 |
| 6,309,290 | B1 * | 10/2001 | Wang et al. | 451/398 |
| 6,398,906 | B1 * | 6/2002 | Kobayashi et al. | 156/345.12 |
| 6,758,939 | B2 * | 7/2004 | Marquardt et al. | 156/345.14 |
| 6,890,249 | B1 * | 5/2005 | Zuniga et al. | 451/398 |
| 2004/0092217 | A1 * | 5/2004 | Marquardt | 451/288 |

FOREIGN PATENT DOCUMENTS

| | | |
|---|---|---|
| JP | A 11-333711 | 12/1999 |
| JP | B2 3045966 | 3/2000 |
| JP | A 2000-190203 | 7/2000 |
| JP | B2 3158934 | 2/2001 |
| JP | A 2001-079757 | 3/2001 |
| JP | A 2003-220549 | 8/2003 |

* cited by examiner

POLISHING HEAD, POLISHING APPARATUS AND POLISHING METHOD FOR SEMICONDUCTOR WAFER

TECHNICAL FIELD

The present invention relates to a polishing head for holding a semiconductor wafer such as a silicon wafer when the surface of the wafer is polished, a polishing apparatus comprising the polishing head, and a polishing method.

BACKGROUND ART

Apparatuses for polishing the surfaces of semiconductor wafers such as silicon wafers include single side polishing apparatuses polishing one sides of wafers at a time, and double side polishing apparatuses polishing both sides of wafers at a time.

As shown in FIG. 12, a typical single side polishing apparatus is composed of a turntable 73 to which a polishing pad 74 is attached, a mechanism 76 of providing a polishing agent, a polishing head 72, and the like. A wafer W is polished with such a polishing apparatus 71 by rubbing the surface of the wafer W against the polishing pad 74 while the wafer W is held by the polishing head 72, the mechanism 76 of providing a polishing agent 75 to the polishing pad 74, and the turn table 73 and the polishing head 72 are rotated respectively.

Wafers can be held by a method of sticking the wafers on a flat disklike plate with an adhesive such as wax or the like, a method of sticking with water the wafers on a soft pad (a backing pad), a method of sucking the wafers with vacuum, or the like.

FIG. 14 illustrates a schematic example of a polishing head holding a wafer with a backing pad. This polishing head 91 has an elastic pad (a backing pad) 95 made of polyurethane or the like on the underside of a disklike carrier 92 made of ceramic or the like. The pad 95 is dampened with water to hold a wafer W with surface tension. In addition, in order to prevent the wafer W from coming off from the carrier 92, a ring (retainer ring) 94 is provided around the carrier 92.

For example, when a silicon wafer is polished, the retainer ring is typically made of plastic such as phenylene sulfide, which is softer than silicon single crystals for the purpose of preventing generation of scratches or impressions on the edge portion of the wafer and for the purpose of preventing metallic contamination. However, because a polishing agent enters between the retainer ring and the edge portion of the wafer (a chamfered portion) during polishing and the wafer rotates freely during polishing, the wafer comes into contact with the retainer ring, thereby polishing the inner periphery of the retainer ring and forming a groove there. When the edge portion of the wafer is caught in the groove, the wafer being pressed uniformly over the surface by the carrier is further pressed by the retainer ring, and which affects polishing of the outer periphery of the wafer. As a result, there is a problem that the outer periphery of the polished wafer has a degraded flatness level.

Therefore, in order to prevent the degradation of flatness level in the outer periphery of a wafer, it is necessary to change the retainer ring frequently, resulting in increase in cost.

In order to prevent excessive polishing in the outer periphery of a wafer, a polishing head with a tube or a diaphragm for adjusting pressing force of a retainer ring separated from a pressing force adjusting mechanism of a carrier (see Japanese Patent Publication No. 3158934). It is stated that the excessive polishing in the outer periphery of a wafer can be prevented as a result of adjusting pressing force of the retainer ring against the polishing pad by such a mechanism of adjusting pressing force of the retainer ring to prevent waviness deformation of the polishing pad.

In order to prevent a wafer from being unfastened from a carrier during polishing, a polishing head is suggested that has a ring guide around the carrier; a pressure ring for pressing a polishing pad, the pressure ring being outside of the ring guide; and an air cylinder or a roller for adjusting pressing force of the pressure ring (see Japanese Patent Publication No. 3045966).

Typically, the pressure ring is made of a hard material such as ceramic that is less prone to wear and has less frictional resistance against a polishing pad. When the pressing force adjusting mechanism designed specifically for the pressure ring (the retainer ring) is provided, pressing force of the pressure ring can be prevented from directly influencing on pressing force of the wafer. However, both the wafer and the pressure ring are always subjected to strong force in the thrust direction during polishing due to friction against a polishing pad. Typically, a wafer has a coefficient of friction larger than the pressure ring during polishing. When foreign matters such as a polishing agent enters where the edge portion of the wafer comes into contact with the inner periphery of a guide ring that holds the wafer, because the pressing force adjusting mechanism for the wafer and the pressing force adjusting mechanism for the pressure ring are separated and independent of each other, the wafer comes in contact with the pressure ring due to sideways deviation of the wafer, the guide ring or the carrier. As a result, impressions or scratches tend to be generated on the edge portion of the wafer even when the inner periphery of the guide ring holding the wafer is made of plastic.

DISCLOSURE OF THE INVENTION

The present invention is accomplished in view of the aforementioned problems, and its major object is to provide a polishing head that can prevent excessive polishing in the outer periphery of a semiconductor wafer and effectively prevent generation of impressions or scratches on the edge portion of the wafer.

The present invention provides a polishing head for holding a semiconductor wafer in the case of polishing the semiconductor wafer by rubbing a surface of the wafer against a polishing pad attached on a turn table; the polishing head at least comprising:

a disklike carrier for holding a back surface of the wafer;

a guide ring for holding an edge portion of the wafer, the guide ring extending downward along an outer periphery of the carrier from a surface of the carrier holding the back surface of the wafer;

a dress ring for pressing the polishing pad, the dress ring being located around the guide ring; and a head body that holds the carrier, the guide ring, and the dress ring, the head body being rotatable and having a reversed-bowl shape with a hollow, wherein the dress ring, and at least the guide ring or the carrier are held by being coupled to a lower brim of the head body via a diaphragm, sealing the hollow of the head body; the wafer is polished while the diaphragm is deformed elastically by adjusting pressure of the sealed hollow with a pressure regulating mechanism so as to press with a given pressing force the wafer and the dress ring against the polishing pad on the turn table, the wafer held by the carrier and the dress ring are rotated, and the pressure regulating mechanism communicates with the hollow.

As mentioned above, in the polishing head according to the present invention, the dress ring, and at least the guide ring or the carrier are held by being coupled to the head body via the same diaphragm. The wafer held by the carrier and the dress ring moves together substantially during polishing in response to sideways deformation of the diaphragm. Therefore, even when frictional forces in the thrust direction of the wafer and the dress ring differ from each other, the impact of the edge portion of the wafer hitting the dress ring via the guide ring can be extremely reduced, thereby effectively preventing generation of impressions or the like on the edge portion of the wafer. In addition, the dress ring presses the polishing pad around the wafer to prevent waviness deformation of the polishing pad. As a result, excessive polishing in the outer periphery of the wafer can be effectively prevented. Furthermore, there is another advantage that the guide ring has increased life because grooves are not formed in the guide ring due to contact with the wafer.

In the above case, it is possible that the polishing head has a back plate located over the carrier; the back plate is mounted on the dress ring via the diaphragm so that the hollow of the head body is separated into two chambers; the diaphragm is deformed elastically between the dress ring and the carrier during polishing by adjusting pressure of the lower chamber with a mechanism communicating with the lower chamber for adjusting pressing force of the wafer so as to further adjust the pressing force of the wafer held by the carrier against the polishing pad.

As mentioned above, when the back plate is located over the carrier and the pressing force of the wafer can be adjusted separately by elastically deforming the diaphragm between the dress ring and the carrier, it is possible to control the pressing force of the wafer held by the carrier to be slightly different from the pressing force of the dress ring. Such fine adjustments of the pressing forces make it possible to effectively prevent excessive polishing in the outer periphery of a wafer and generation of impressions on the edge portion of the wafer.

In the above cases, a backing pad is preferably provided to the surface of the carrier holding the back surface of the wafer.

Use of a polishing head with the backing pad makes it possible to polish the wafer by holding the wafer more securely. Therefore, use of such a polishing head makes it possible to prevent generation of impressions or the like on the edge portion of the wafer, thereby providing semiconductor wafers of high quality.

The carrier can be a ceramic plate.

When the carrier is a ceramic plate, metallic contamination or the like of the semiconductor wafer can be prevented. In addition, such a carrier has high rigidity and thus suitable for providing wafers with high flatness.

It is possible that a through-hole is formed for holding the wafer by vacuum suction; the through-hole runs along a direction of a thickness of the carrier; the polishing head comprises a mechanism of sucking the wafer; and the mechanism communicates with the through-hole.

When the polishing head with such a mechanism of sucking a wafer is used, the wafer can be polished with holding the wafer more firmly. In addition, after the polishing, the wafer can be detached from the carrier easily by spraying gas on the back surface of the wafer via the through-hole of the carrier.

It is possible that the carrier is a flexible film; the polishing head comprises a retaining plate with a through-hole for retaining the flexible film, a mechanism of sucking the wafer and a mechanism of adjusting pressing force that communicate with the through-hole of the retaining plate.

The wafer can be held firmly and pressing force of the wafer can be adjusted during polishing by vacuum suction with the flexible film and the retaining plate dividing the hollow of the head body. In addition, after the polishing, the wafer can be detached from the carrier easily by spraying gas via line from the through-hole of the retaining plate and inflating the flexible film.

The present invention provides a polishing apparatus used for polishing a surface of a semiconductor wafer at least comprising: a polishing pad attached on a turn table; a mechanism of providing a polishing agent to the polishing pad; and a polishing head for holding the semiconductor wafer, which is the polishing head according to the present invention.

Use of the polishing apparatus comprising the polishing head according to the present invention can extremely reduce the impact of the edge portion of the wafer hitting the dress ring via the guide ring, thereby effectively preventing generation of impressions or the like on the edge portion of the wafer. In addition, the dress ring prevents waviness deformation of the polishing pad. As a result, excessive polishing in the outer periphery of the wafer can be prevented.

The present invention provides a method for polishing a surface of a semiconductor wafer wherein, the surface is polished with holding the wafer by the polishing head according to the present invention, while the diaphragm is deformed elastically by adjusting pressure of the sealed hollow of the head body with a pressure regulating mechanism so as to press with a given pressing force the wafer and the dress ring against the polishing pad on the turn table, the wafer held by the carrier and the dress ring are rotated, and the pressure regulating mechanism communicates with the hollow.

That is, by polishing the surface of a semiconductor wafer with the polishing head according to the present invention, the impact of the edge portion of the wafer hitting the dress ring via the guide ring can be extremely reduced. In addition, the dress ring prevents waviness deformation of the polishing pad. As a result, the semiconductor wafer can be finished to be of high quality in which impressions on the edge portion of the wafer and excessive polishing in the outer periphery of the wafer are extremely rare.

In the polishing head according to the present invention, the head body, the dress ring for pressing the polishing pad, and the guide ring and/or the carrier for holding the wafer are coupled through the diaphragm. Thus the dress ring and the wafer held by the carrier move together during polishing through elastic deformation of the diaphragm. Therefore, even when frictional forces of the wafer and the dress ring in the thrust direction differ from each other, the impact of the edge portion of the wafer hitting the dress ring via the guide ring can be extremely reduced, thereby effectively preventing generation of impressions or scratches on the edge portion of the wafer.

In addition, the edge portion of the wafer is held with the guide ring while the guide ring does not press the polishing pad. As a result, uniform load can be applied over the wafer to its outer periphery. On the other hand, the dress ring located outside of the guide ring presses the polishing pad, thereby preventing waviness deformation of the polishing pad. Therefore, when a wafer is polished with holding the wafer by using such a polishing head, the wafer can be finished to have high flatness over the wafer surface even in its outer periphery.

Furthermore, there is another advantage that the guide ring has increased life because grooves are not formed in the guide ring due to contact with the wafer.

BRIEF EXPLANATION OF THE DRAWINGS

FIG. 3 is a schematic view of a third embodiment of the polishing head according to the present invention.

FIG. 6 is a schematic view of a sixth embodiment of the polishing head according to the present invention.

BEST MODE FOR CARRYING OUT THE INVENTION

Hereinafter, a more thorough disclosure of the polishing head and the polishing apparatus according to the present invention is presented with referring to the attached drawings in the detailed description which follows.

Figure 1:
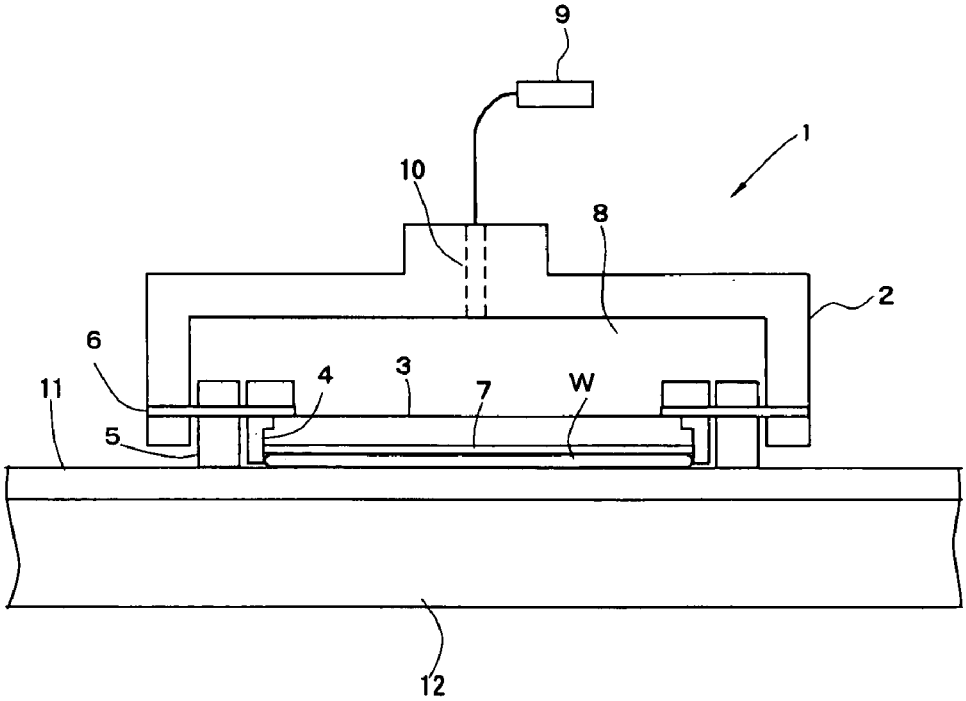
FIG. 1 is a schematic view of a first embodiment of the polishing head according to the present invention.

FIG. 1 illustrates an example (a first embodiment) of the polishing head according to the present invention. This polishing head 1 comprises a head body 2 with a reversed-bowl shape. Inside of the head body 2, a hollow 8 is formed. The head body 2 is rotatable. At the top central of the head body 2, a through-hole 10 for adjusting pressure is provided. The through-hole 10 communicates with a pressure regulating mechanism 9.

A disklike carrier 3, a guide ring 4, and a dress ring 5 are located concentrically. The carrier 3, the guide ring 4, and the dress ring 5 are coupled to a lower brim of the head body 2 via a diaphragm 6. By such a coupling via the diaphragm 6, the head body 2 holds the carrier 3, the guide ring 4, and the dress ring 5; and the hollow 8 of the head body 2 is sealed.

The diaphragm 6 is preferably formed by using a material of high elasticity such as an elastomer, or a rubber. A single diaphragm 6 made of such a material is fastened to the head body 2, the dress ring 5, the carrier 3, and the guide ring 4 by using bolts or the like. As a result of this, the coupling is achieved and the hollow 8 of the head body 2 is sealed.

The carrier 3 is used to hold the back surface (the opposite surface to the surface being polished) of a semiconductor wafer W. The carrier 3 preferably has high rigidity and does not cause metallic contamination in the wafer W. For example, a circular plate made of ceramic such as alumina is preferably used.

The carrier 3 supports the entire back surface of the wafer W, and thus preferably has a diameter as large as or slightly larger than the wafer W to be polished.

A sheet-like elastic body (a backing pad 7) is provided to the surface (holding surface) of the carrier 3 holding the back surface of the wafer W. For example, a backing pad 7 made of expanded polyurethane is fastened to the holding surface of the carrier (ceramic plate) 3 with an adhesive double coated tape or the like. By providing the backing pad 7 and dampening the backing pad 7 with water, the wafer W can be held more firmly with surface tension of water contained in the backing pad 7.

The guide ring 4 is installed around the outer periphery of the carrier 3. The guide ring 4 is used for holding the edge portion of the wafer W. The guide ring 4 extends downward along the outer periphery of the carrier 3 from the surface (holding surface) of the carrier 3 holding the back surface of the wafer W. It should be noted that the guide ring 4 is used to hold the edge portion of the wafer W during polishing to prevent the wafer W from being detached from the carrier 3 while the guide ring 4 does not press a polishing pad 11. For example, when the guide ring 4 is used to polish a standard silicon wafer with a thickness of about 0.8 mm, the guide ring 4 may extend from the holding surface of the carrier 3 or the backing pad 7 in the range of about 0.4 to 0.7 mm.

The guide ring 4 is used to hold the edge portion of the wafer W during polishing to prevent the wafer W from being detached. Therefore, the guide ring 4 is not necessary to have a thick width. In general, the guide ring 4 has a thickness of about 0.3 to 3 mm.

Alternatively, the guide ring 4 and the carrier 3 may be formed as a single-piece, and this piece may be coupled to the diaphragm 6. Even when the guide ring 4 is fit around the carrier 3, as long as the guide ring 4 and the carrier 3 are integrated, the diaphragm 6 may be coupled to either the carrier 3 or the guide ring 4.

The guide ring 4 is preferably made of a material softer than the wafer W for the purpose of not contaminating the wafer and not generating scratches or impressions. For example, for polishing silicon wafers, a preferred guide ring is made of plastic such as polyether-ketone (PEEK), polyacetal (POM), MC nylon, polyethylene terephthalate (PET), or polyphenylene sulfide (PPS).

It should be noted that when the carrier and the guide ring are formed as a single-piece, the portion with which the edge portion of a wafer comes into contact, namely the inner periphery of the guide ring is preferably formed with plastic such as PEEK, POM, MC nylon, PET, or PPS mentioned above.

The dress ring 5 is located around the guide ring 4. The dress ring 5 presses the polishing pad 11 during polishing to prevent waviness deformation of the polishing pad 11. The dress ring 5 preferably has a relatively thick width such as about 5 to 30 mm.

The dress ring 5 is preferably made of a material that does not cause metallic contamination in wafers, and that wears as less as possible upon contact with the polishing pad 11. For example, a ring made of alumina may be preferably used as the dress ring.

There are a slight spacing between the guide ring 4 and the dress ring 5 so that the diaphragm 6 can deform elastically in the spacing. When the spacing is too narrow, the diaphragm 6 is less prone to deform elastically. On the other hand, when the spacing is too wide, waviness deformation of the polishing pad 11 can be caused around the wafer. Therefore, the spacing between the guide ring 4 and the dress ring 5 is preferably about 0.2 to 2 mm.

The dress ring 5 is coupled to a lower brim of the head body 2 via the diaphragm 6. A spacing is also provided between the lower brim of the head body 2 and the dress ring 5 so that the diaphragm 6 can deform elastically. The spacing between the head body 2 and the dress ring 5 is preferably about 0.5 to 15 mm in order that the diaphragm 6 can deform elastically and the polishing head is prevented from increasing in size.

Figure 7:
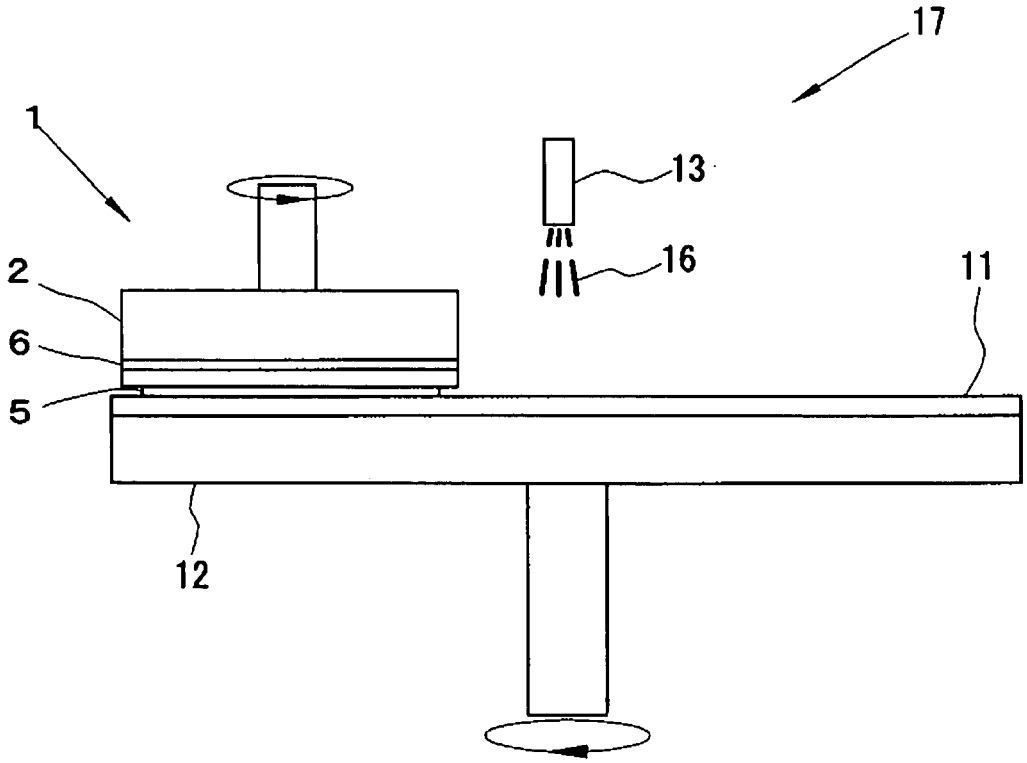
FIG. 7 is a schematic view of an example of a polishing apparatus comprising the polishing head according to the present invention.

FIG. 7 is a schematic view of a polishing apparatus 17 comprising the polishing head 1. This polishing apparatus 17 comprises the polishing head 1 as well as a polishing pad 11 attached on a turn table 12; and a mechanism 13 of providing a polishing agent 16 to the polishing pad 11.

Hereinafter, a disclosure is presented with referring to FIGS. 1 and 7.

When a wafer W is polished with the polishing apparatus 17, first, the wafer W is placed on the backing pad 7 dampened with water to hold the back surface of the wafer W with the carrier 3; and the edge portion of the wafer W is held with the guide ring 4.

Then the polishing agent 16 is provided to the polishing pad 11 from the mechanism 13 of providing a polishing agent while the wafer W is rubbed against the polishing pad 11 with rotating the polishing head 1 and the turn table 12 to each prescribed direction. At this time, the diaphragm 6 can be deformed elastically by regulating the pressure in the sealed hollow 8 in the head body 2 with a pressure regulating mechanism 9. For example, by providing compressed air to the hollow 8 from the pressure regulating mechanism 9, the diaphragm 6 is deformed elastically among the lower brim of the head body 2, the guide ring 4, and the dress ring 5; and thus the carrier 3, the guide ring 4, and the dress ring 5 are pressed simultaneously under the same pressure and projected to the side of the polishing pad 11. In this way, by elastically deforming the diaphragm 6 with the pressure regulating mechanism 9, the surface of the wafer W can be polished while the wafer W held by the carrier 3 and the dress ring are pressed with prescribed pressure against the polishing pad 11 on the turn table 12; and the wafer W and the dress ring 5 are rotated in relation to the polishing pad 11.

When the wafer W is polished with such a polishing apparatus 17 comprising the polishing head 1, the edge portion of the wafer W is held with the guide ring 4 which does not press the polishing pad 11, whereby uniform load can be applied over the wafer to its outer periphery. On the other hand, the dress ring 5 located around the guide ring 4 presses the polishing pad 11, thereby preventing waviness deformation of the polishing pad 11. As a result, excessive polishing in the outer periphery of the wafer W can be prevented effectively. Furthermore, the dress ring 5, the guide ring 4 and the carrier 3 are coupled via one and the same diaphragm 6 and held by the head body 2. As a result, even when frictional forces of the dress ring 5, the guide ring 4 and the carrier 3 in the thrust direction differ from each other, the dress ring 5, the guide ring 4 and the carrier 3 move together mildly as the wafer moves. Thus the impact of the edge portion of the wafer W hitting the dress ring 5 via the guide ring 4 can be extremely reduced, thereby effectively preventing generation of impressions or scratches on the edge portion. In addition, generation of grooves in the inner wall of the dress ring 5 is also effectively prevented.

It should be noted that after the wafer is polished, the wafer can be detached easily by spraying water between the guide ring 4 and the edge portion of the wafer W.

Figure 2:
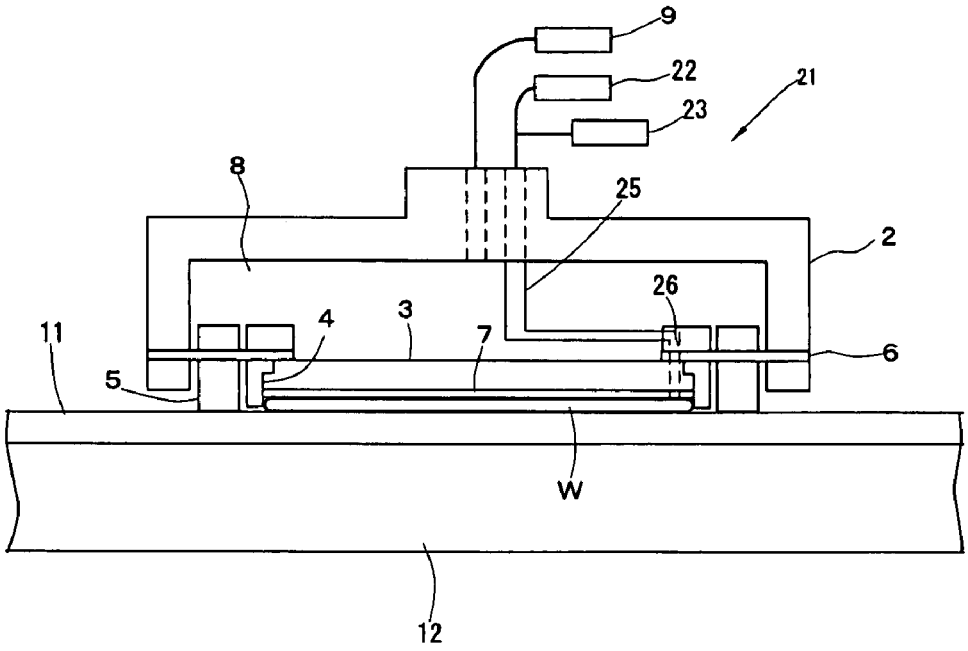
FIG. 2 is a schematic view of a second embodiment of the polishing head according to the present invention.

FIG. 2 shows a second embodiment of the polishing head according to the present invention. This polishing head 21 comprises a carrier 3, the diaphragm 6 and a plurality of through-holes 26 for holding the wafer W by vacuum suction. The through-holes run along the direction of the thickness of the backing pad 7. In addition to the pressure regulating mechanism 9 for regulating pressure of the hollow 8 in the head body 2, a mechanism 22 of sucking the wafer is provided to the polishing head 21. The wafer suction mechanism 22 communicates with the through-holes 26 of the carrier 3 and the like via a wafer suction line 25. Use of such a polishing head 21 makes it possible to suck and hold the wafer W more certainly by suction of the backing pad 7 and vacuum suction of the wafer suction mechanism 22.

After the polishing is complete, the wafer W can be detached from the carrier 3 (the backing pad 7) easily, for example, by spraying air on the back surface of the wafer W via the through-holes 26 of the carrier 3 or the like from a mechanism 23 for providing air. In FIG. 2, the polishing head 21 comprises the wafer suction mechanism 22 and the air providing mechanism 23 separately. However, one mechanism functioning as both the wafer suction mechanism and the air providing mechanism can be used.

Figure 3A:
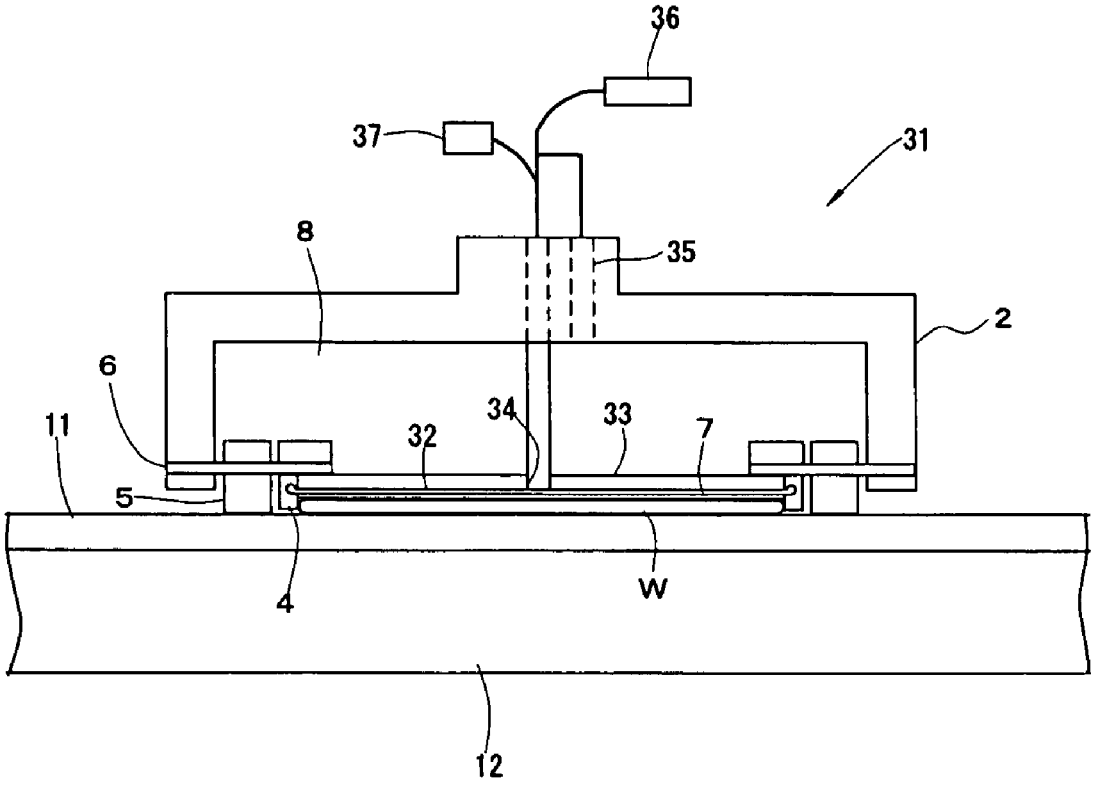
FIG. 3(A) shows the state that the polishing head holds a wafer.
Figure 3B:
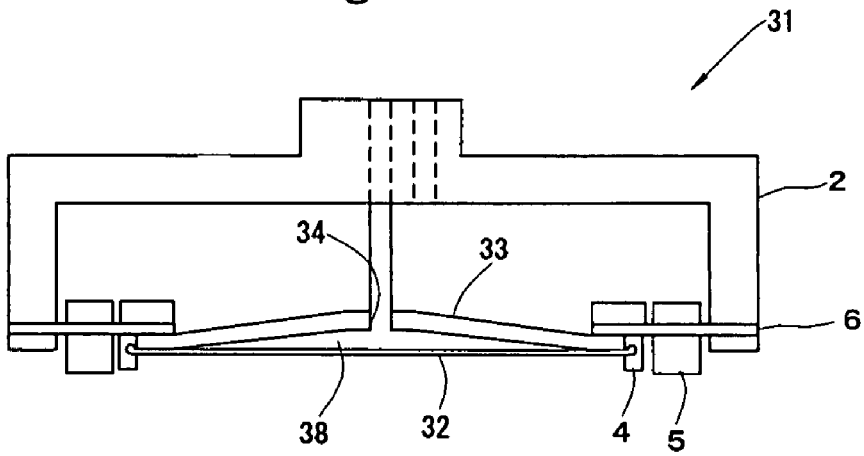
FIG. 3(B) shows the state that the polishing head does not hold a wafer.

FIG. 3(A) and FIG. 3(B) show a third embodiment of the polishing head according to the present invention. This polishing head 31 comprises a flexible film 32 as a carrier. The flexible film 32 can be formed with a synthetic rubber such as a rigid polyurethane rubber or EPDM. A retaining plate 33 is provided to the back side of the flexible film 32. The retaining plate 33 retains the flexible film 32 and functions for holding a wafer W by vacuum suction.

When the wafer W is not being sucked, as shown in FIG. 3(B), the retaining plate 33 has a convex shape mildly rising from the periphery to the central. A hollow 38 is formed between the retaining plate 33 and the flexible film 32. A through-hole 34 is formed at the center of the retaining plate 33. The through-hole 34 communicates with a pressure regulating mechanism 36 and the like.

It should be noted that FIG. 3(B) is not drawn to scale for the purpose of emphasizing features.

The retaining plate 33 can be formed with a metal such as SUS or titanium.

In order to hold a wafer with such a polishing head 31, the flexible film 32 is dampened with water, or a sheet-like elastic body (a backing pad 7) is placed on the surface of the flexible film 32 with an adhesive double coated tape or the like, and the backing pad 7 is dampened with water. Then by forming a negative pressure in the hollow 38 between the flexible film 32 and the retaining plate 33, the flexible film 32 follows the shape of the retaining plate 33. As a result, the wafer W can be held by suction. Vacuum for providing the negative pressure can be adjusted, for example, by using a regulator 37 through the same line as a pressure regulating mechanism 36 as shown in FIG. 3(A). By using the pressure regulating mechanism 36 and the regulator 37, suction and pressing force of a wafer can be controlled.

In the polishing head 31, the diaphragm 6 can also be deformed elastically by adjusting the pressure in the sealed hollow 8 in the head body 2 with the pressure regulating mechanism 36 via a through-hole 35. The flexible film 32 can also be deformed elastically by adjusting the pressure in the hollow 38 with the pressure regulating mechanism 36 via a through-hole 34. Consequently, the wafer W held by the flexible film 32 can be polished while the wafer W and the dress ring 5 are rotated and pressed with a prescribed pressing force against the polishing pad attached 11 on the turn table 12.

After the polishing, the wafer W can be detached easily by spraying air to inflate the flexible film 32 via the line communicating with the through-hole 34 in the retaining plate 33.

Figure 4:
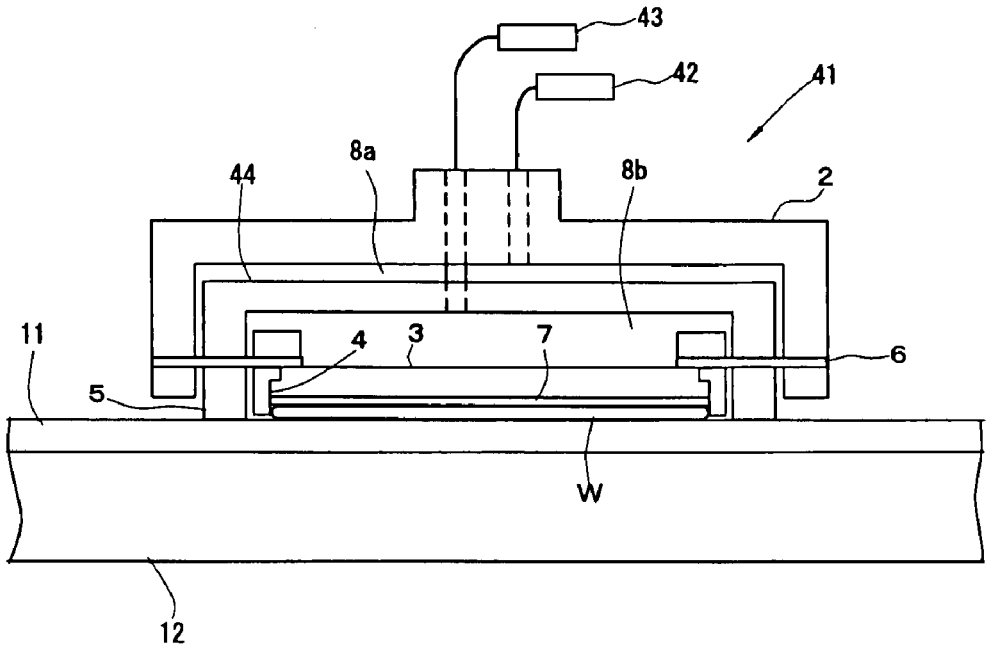
FIG. 4 is a schematic view of a fourth embodiment of the polishing head according to the present invention.

FIG. 4 shows a fourth embodiment of the polishing head according to the present invention. This polishing head 41 has a back plate 44 located over the carrier (ceramic plate) 3. The back plate 44 is mounted on a dress ring 5 via a diaphragm 6. The back plate 44 is fastened to the dress ring 5 via the diaphragm 6, thereby separating the hollow of a head body 2 into two chambers 8*a* and 8*b*. The upper chamber 8*a* communicates with a pressure regulating mechanism 42. The lower chamber 8*b* communicates with a mechanism 43 for adjusting pressing force of the wafer.

In the polishing head 41 having such a configuration, supply of compressed air or the like from the pressure regulating mechanism 42 deforms the diaphragm 6 elastically between the head body 2 and the dress ring 5, whereby pressing force of the wafer W held by the carrier 3 and pressing force of the dress ring 5 can be adjusted. On the other hand, the pressure of the lower chamber 8*b* is adjusted by supply of air or the like from the mechanism 43 for adjusting pressing force of the wafer, whereby the diaphragm 6 is elastically deformed between the dress ring 5 and the carrier 3. Thus pressing force of the wafer W, held by the carrier 3, against the polishing pad 11 can be minutely controlled. Therefore, pressing force of the wafer W and pressing force of the dress ring 5 can be controlled independently.

After being polished, the wafer W can be detached easily by spraying water between the guide ring 4 and the edge portion of the wafer W.

Figure 5:
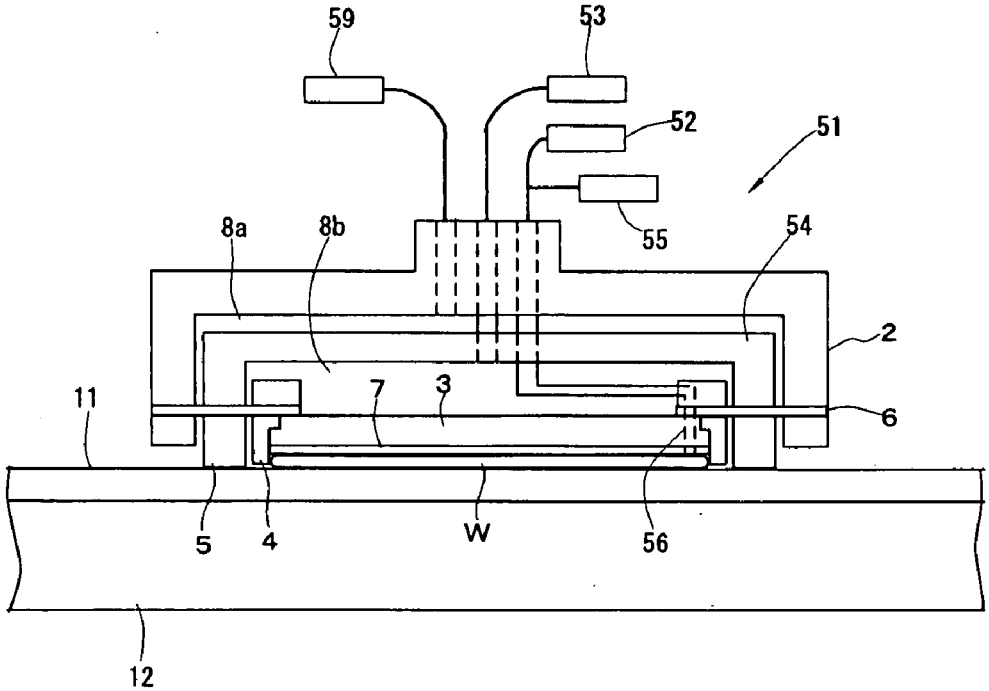
FIG. 5 is a schematic view of a fifth embodiment of the polishing head according to the present invention.

FIG. 5 shows a fifth embodiment of the polishing head according to the present invention. This polishing head 51 has a back plate 54 located over a ceramic plate (carrier) 3 as with the fourth embodiment. Furthermore, as with the second embodiment, a through-hole 56 for holding a wafer W by vacuum suction is formed in a carrier 3, a diaphragm 6 and a backing pad 7. Furthermore, the polishing head 51 comprises a mechanism 52 of sucking the wafer. This mechanism communicates with through-hole 56.

By using the polishing head 51 with such a configuration, the wafer W can be certainly held by suction with the backing pad 7 and the mechanism 52 of sucking the wafer as with the second embodiment. Furthermore, as with the fourth embodiment, pressing force of the wafer W and pressing force of the dress ring 5 can be controlled independently by using a pressure regulating mechanism 59 and the wafer pressing force adjusting mechanism 53. In addition, a wafer after being polished can be detached easily by using an air supplying mechanism 55.

Figure 6A:
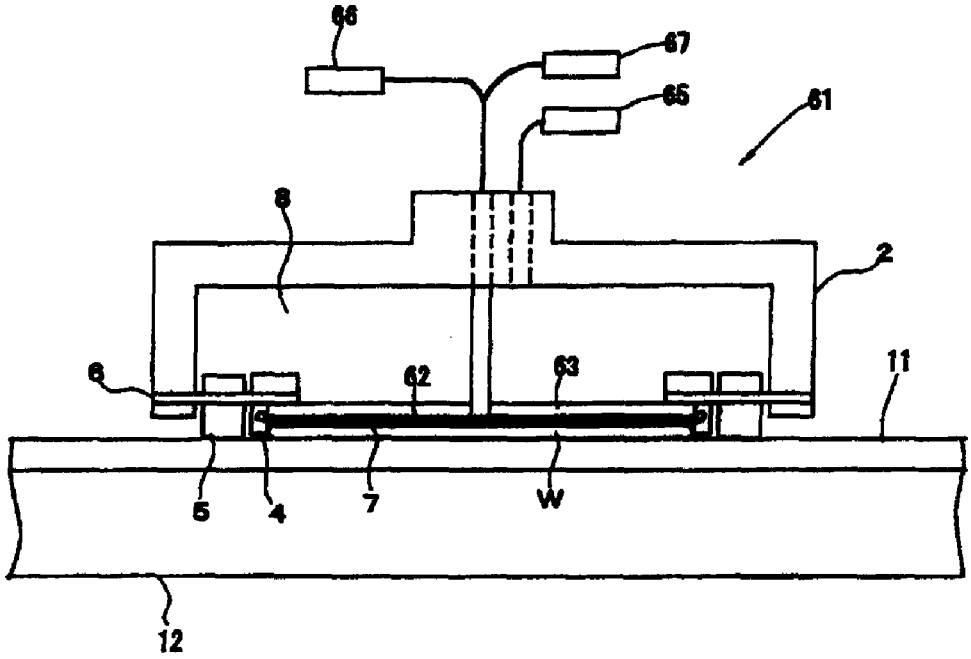
FIG. 6(A) shows the state that the polishing head holds a wafer.
Figure 6B:
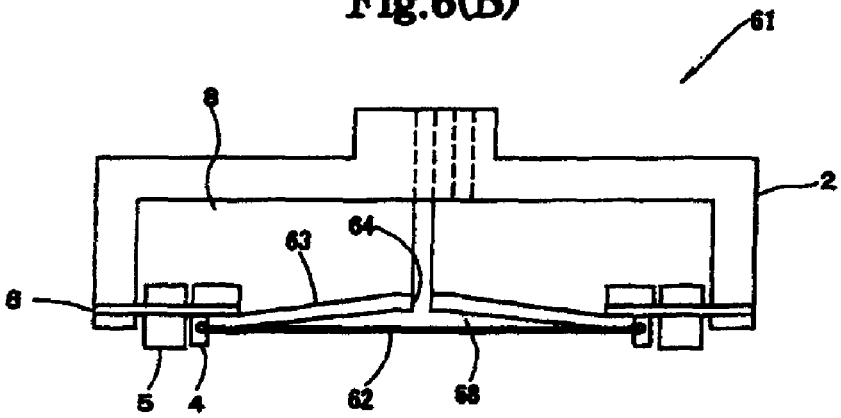
FIG. 6(B) shows the state that the polishing head does not hold a wafer.

FIG. 6(A) and FIG. 6(B) show a sixth embodiment of the polishing head according to the present invention. This polishing head 61 comprises a carrier 62 of a flexible film and a retaining plate 63 as with the third embodiment shown in FIG. 3. As shown in FIG. 6(B), a hollow 68 is formed between the retaining plate 63 and the flexible film 62. A through-hole 64 is formed at the center of the retaining plate 63. The through-hole 64 communicates with a wafer pressing force adjusting mechanism 66 and the like.

It should be noted that FIG. 6(B) is not drawn to scale for the purpose of emphasizing features.

The wafer W can be detached and attached at will with a wafer suction mechanism 67 communicating with the retaining plate 63. By using a pressure regulating mechanism 65 communicating with the hollow 8, pressing force of the wafer W held by the carrier 62, and pressing force of the dress ring 5 can be adjusted. Furthermore, by using wafer pressing force adjusting mechanism 66 communicating with the hollow 68, pressing force of the wafer W can be adjusted minutely.

Therefore, when the wafer W being held by the polishing head 61 is polished, detachment/attachment of the wafer W, pressing force of the dress ring 5, and pressing force of the wafer W can be controlled at will.

Hereinafter, Examples according to the present invention and Comparative Examples are described.

EXAMPLE 1

A polishing head having the configuration shown in FIG. 1 was prepared as follows. A head body made of stainless was prepared. A ceramic plate (301 mm across) was used as a carrier. A guide ring (width: 2 mm) made of PEEK was fit around the carrier. A dress ring made of alumina was located around the outer periphery of the guide ring at an interval of about 0.5 mm. Then the carrier, the guide ring, the dress ring and the head body are coupled via a single diaphragm made of synthetic rubber. Thus a polishing head having one chamber (hollow) inside (single chamber polishing head) was prepared.

By using a polishing apparatus comprising the polishing pad, a silicon wafer with a 300 mm diameter was polished. Before the polishing, both sides of the silicon wafer were subjected to primary polishing and the edge portion of the wafer was also polished. The flatness of the wafer was measured with a flatness measurement system AMS 3200 (manufactured by ADE Corporation). As a result, an average of SFQRmax was 0.13 μm (measurement condition: cell size 26 mm×33 mm, offset 0 mm×16.5 mm, the region within 2 mm from the outer periphery of the wafer was excluded). The SFQRmax is a maximum value of SFQR (Siteflatness Front Surface a site least squares Range: the difference of surface heights of in a site).

As a polishing pad, SUBA600 (manufactured by Nitta Haas Incorporated) was used. As a polishing agent, an alkaline solution containing colloidal silica was used.

During polishing, both the polishing head and a polishing turn table were rotated at 30 rpm. The polishing pressure (pressing force) of the wafer was set at 30 kPa (in the chamber). Period for polishing was adjusted so that a stock removal became 1 μm. After the polishing was complete, the wafer was subjected to SC-1 cleaning.

EXAMPLE 2

A polishing head shown in FIG. 4 was prepared, the polishing head comprising two chambers 8*a* and 8*b*. A carrier, a guide ring, and a dress ring were the same as Example 1.

By using the polishing head, a silicon wafer was polished as with Example 1. The pressure in the chamber 8*a*, used for adjusting polishing pressure of the dress ring, was set at 33 kPa. The pressure in the chamber 8*b*, used for adjusting polishing pressure of the wafer, was set at 30 kPa.

EXAMPLE 3

A polishing head shown in FIG. 3 was prepared, the polishing head comprising a flexible film as a carrier.

By using the polishing head, a silicon wafer was polished as with Example 1. The hollow 8 is used for adjusting pressing force of the wafer and the dress ring. The hollow 8 was set to have a pressure of 30 kPa. The hollow 38 between the flexible film for holding the wafer and the retaining plate was also set to have a pressure of 30 kPa.

EXAMPLE 4

A polishing head as shown in FIG. 6 was prepared, the polishing head comprising a flexible film as a carrier and a mechanism for adjusting polishing pressure of a wafer and a mechanism for adjusting pressing force of a dress ring.

By using the polishing head, a silicon wafer was polished as with Example 1. The hollow 8 was set to have a pressure of 33 kPa. The hollow 8 is used for adjusting polishing pressure of the dress ring. The hollow 68 was set to have a pressure of 30 kPa. The hollow 68 is used for adjusting polishing pressure of the wafer.

COMPARATIVE EXAMPLE 1

Figure 13:
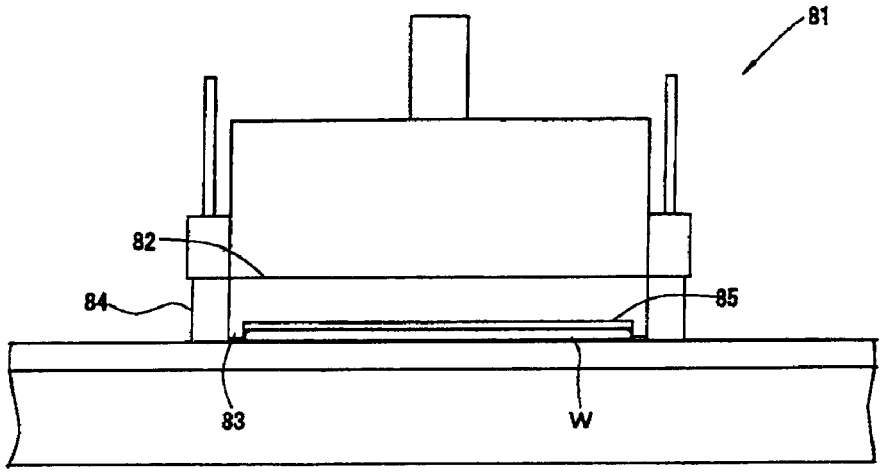
Fig.13 Prior Art
FIG. 13 is a schematic view of a polishing head used in Comparative Examples.

A polishing head 81 as shown in FIG. 13 was prepared. The polishing head 81 had a guide 83 along the outer periphery of a carrier 82, and further had a press ring 84 around the guide 83. The carrier 82 and the press ring 84 were not coupled via a diaphragm or the like. The pressing force of the carrier 82 and the pressing force of the press ring 84 were separately controlled by mechanisms for adjusting pressing force.

By using the polishing head 81, a silicon wafer was polished as with Example 1.

COMPARATIVE EXAMPLE 2

Figure 14:
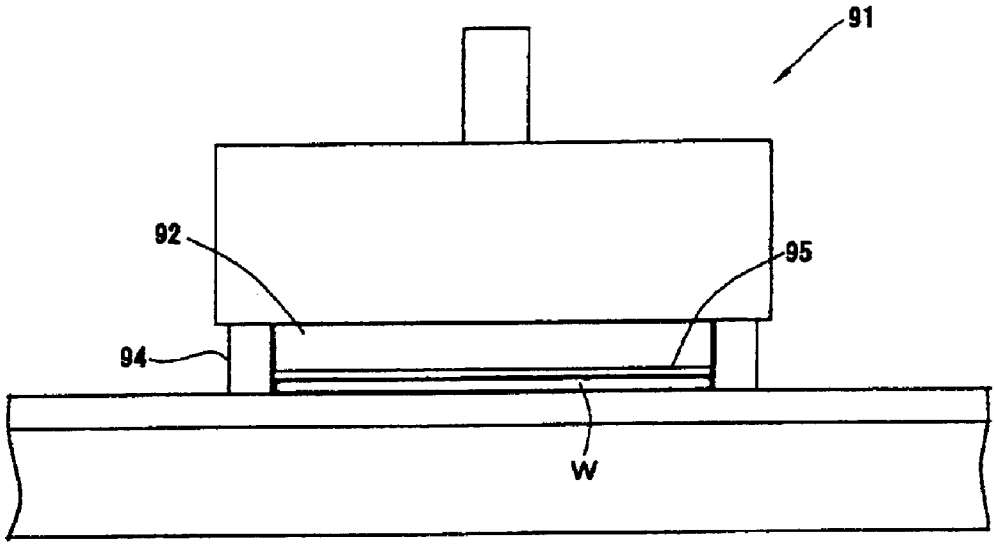
Fig.14 Prior Art
FIG. 14 is a schematic view of an example of a conventional polishing head.

A polishing head 91 shown in FIG. 14 was prepared. The polishing head 91 had a retainer ring 94 along the outer periphery of a carrier 92. The ring 94 was supported by a diaphragm so that the ring 94 could move up and down freely. The carrier 92 and the retainer ring 94 were not coupled via a diaphragm or the like. The pressing force of the carrier 92 and the pressing force of the retainer ring 94 were separately controlled by mechanisms for adjusting pressing force.

By using the polishing head 91, a silicon wafer was polished as with Example 1.

(Evaluation Method of Polished Wafer)

The edge portions of the silicon wafers polished in Examples 1 to 4 and Comparative Examples were evaluated with an automatic detector of defects in wafer edge RXW-1225S (manufactured by RAYTEX CORPORATION).

Figure 8:
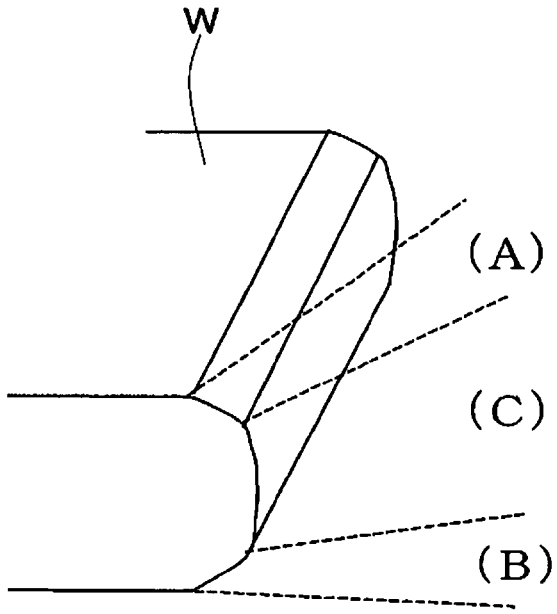
FIG. 8 shows regions (A) and (B) in an edge portion of a polished wafer evaluated in Examples and Comparative Examples.

Specifically, a laser beam was radiated to the entire outer periphery of each wafer, and scattered light was received to inspect the presence of defects. When a defect was generated, an angle of the defect from a notch was determined. Then an image of regions (A), (B), and (C) of the edge portion of a polished wafer was taken with a CCD camera. The regions (A), (B), and (C) are shown in FIG. 8. Then the image was subjected to image processing and pass/fail judgment was made based on the image.

Figure 9:
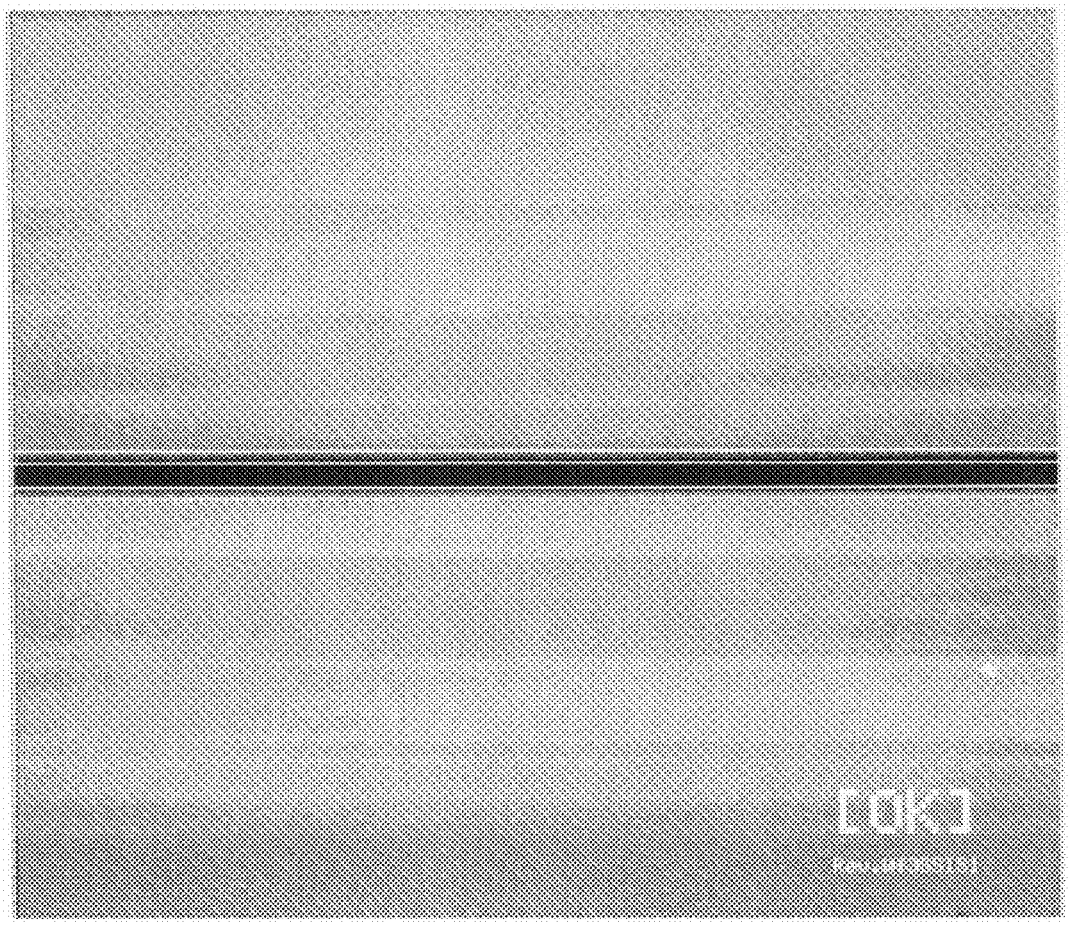
FIG. 9 is a CCD image of an edge portion of a polished wafer (no scratches are observed).
Figure 10:
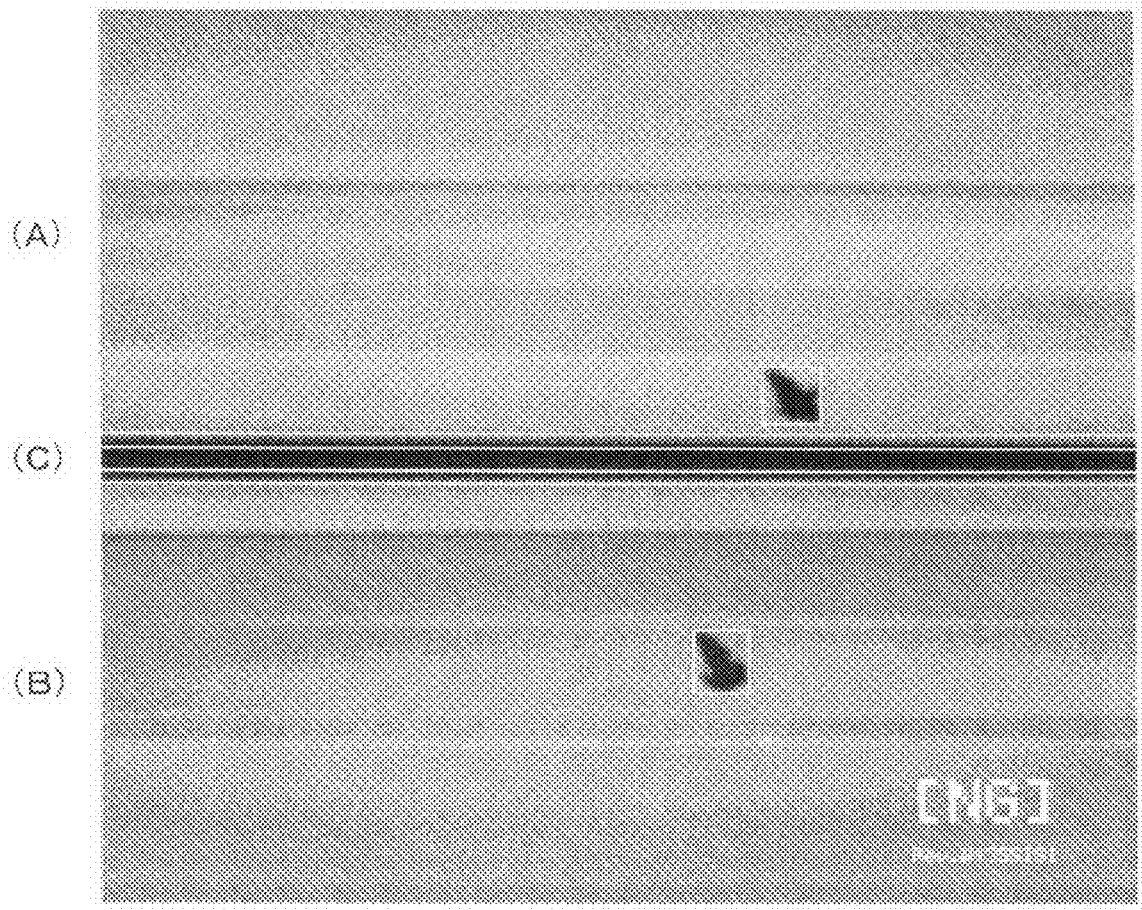
FIG. 10 is a CCD image of an edge portion of a polished wafer (scratches are observed).
Figure 11:
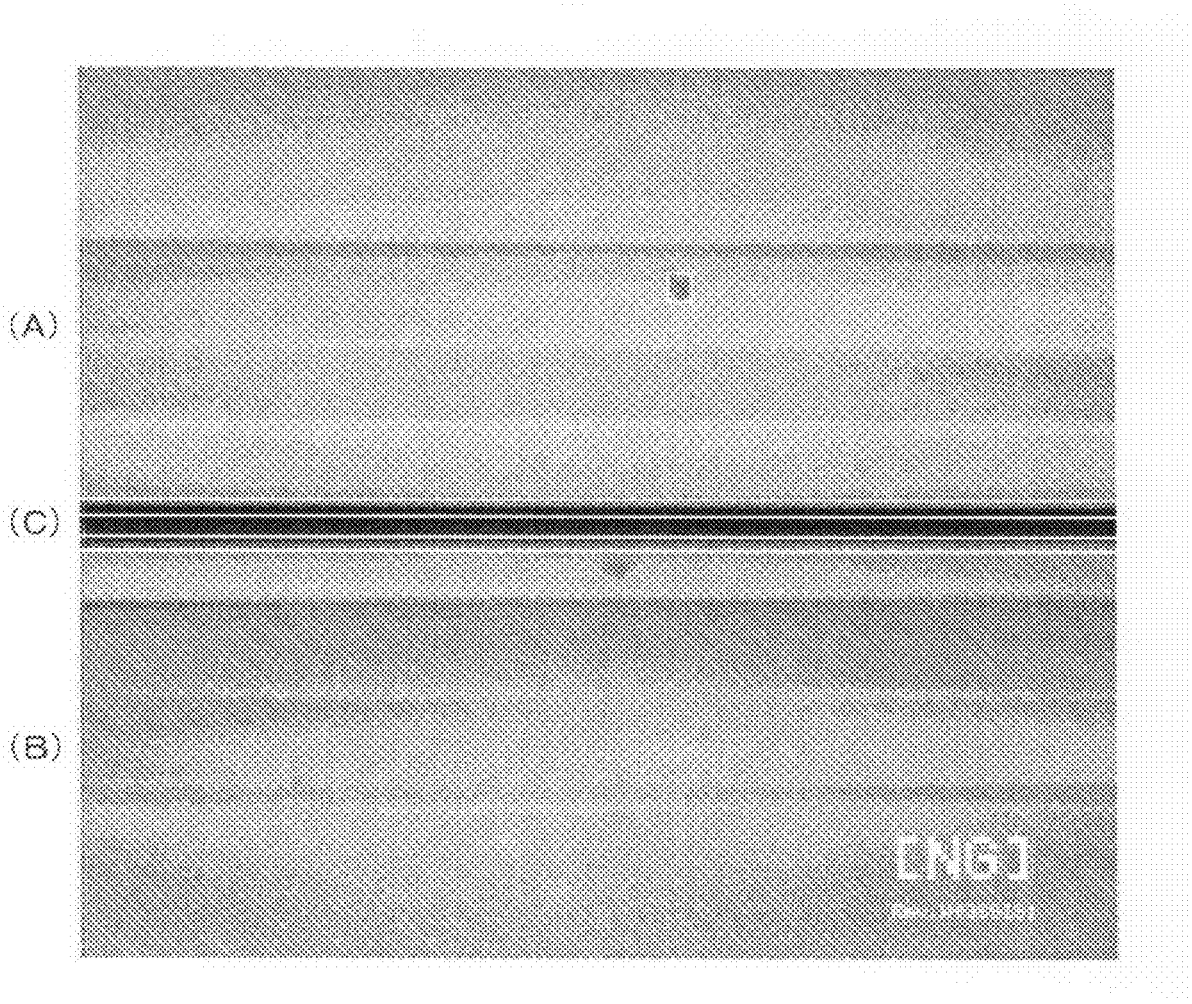
FIG. 11 is another CCD image of an edge portion of a polished wafer (scratches are observed).
Figure 12:
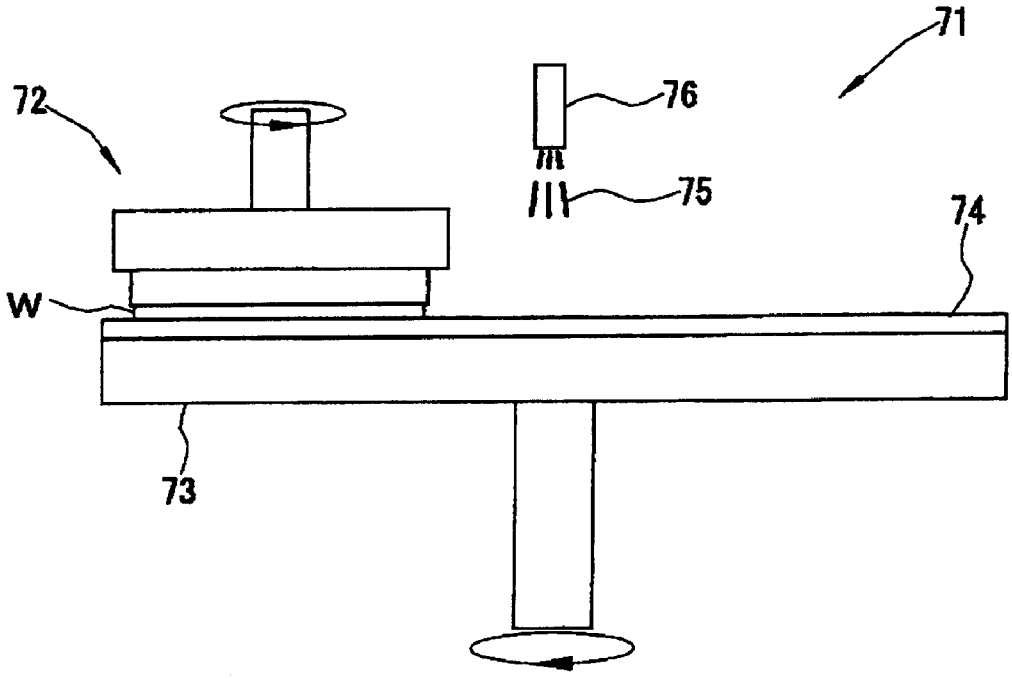
Fig.12 Prior Art
FIG. 12 is a schematic view of an example of a single side polishing apparatus.

FIG. 9 is a CCD camera image of a passed wafer. FIGS. 10 and 11 are CCD camera images of rejected wafers.

(Evaluation Results)

In the case of polishing a wafer with the polishing head of Examples 1 to 4, an average rate of generating impressions or scratches in the edge portion of the wafer was about 1.5%.

In the case of polishing a wafer with the polishing head of Comparative Example 1, a rate of generating scratches in the edge portion of the wafer was 8.5%.

It is considered that when the polishing head of Comparative Example 1 was used, the wafer slid and came into contact with the hard retainer ring, whereby impressions or scratches were often formed on the wafer.

In addition, as to the wafers polished with the polishing heads of Examples 1 to 4 and Comparative Examples 1 and 2, the flatness of each wafer was measured with a flatness measurement system AMS 3200 (manufactured by ADE Corporation) as with Example 1. An average value of SFQRmax of wafers polished with the polishing heads of Examples 1 to 4 was 0.09 μm while an average value of SFQRmax of wafers polished with the polishing head of Comparative Example 1 was 0.11 μm.

On the other hand, in the case of polishing a wafer with the polishing head of Comparative Example 2, an average rate of generating impressions or scratches on the edge portion of the wafer was 1.7%. However, an average value of SFQRmax was poor of 0.18 μm because SFQR values in cells in the outermost region were poor. The reason of this is considered that the retainer ring moved up and down during the polishing and which deteriorated the flatness of the cells in the outermost region.

In contrast to this case, in the case of using the polishing heads of Examples 1 to 4, the head body, the dress ring, the guide ring and the carrier are coupled via the diaphragm; the guide ring and the dress ring slides together due to elastic deformation of the diaphragm, and thus the guide ring and the dress ring hardly collide with each other. Therefore, it is considered that impressions or scratches were less prone to be generated on the edge portions of the wafers.

The present invention is not limited to the embodiments described above. The above-described embodiments are mere examples, and those having substantially the same structure as technical ideas described in the appended claims and providing the similar functions and advantages are included in the scope of the present invention.

For example, the polishing head according to the present invention is not restricted to the embodiments shown in FIGS. 1 to 6. Shapes of the head body or the like can be designed as appropriate.

In addition, the configuration of a polishing apparatus is not restricted to the configuration shown in FIG. 7. For example, a polishing apparatus can comprise a plurality of the polishing heads according to the present invention.

The invention claimed is:

1. A polishing head for holding a semiconductor wafer for polishing the semiconductor wafer by rubbing a surface of the wafer against a polishing pad attached on a turn table; the polishing head comprising:

a disklike carrier for holding a back surface of the wafer;

a guide ring for holding an edge portion of the wafer, the guide ring extending downward along an outer periphery of the carrier from a surface of the carrier holding the back surface of the wafer;

a dress ring for pressing the polishing pad, the dress ring being located around the guide ring;

a head body that holds the carrier, the guide ring, and the dress ring, the head body being rotatable and having a reversed-bowl shape with a hollow;

a through-hole for holding the wafer by vacuum suction, the through-hole runs along a direction of a thickness of the carrier;

a sucking mechanism for sucking the wafer, the sucking mechanism being in communication with the through-hole;

an air providing mechanism for detaching the wafer from the carrier by spraying air on the back surface of the wafer via the through-hole;

a back plate located over the carrier, and wherein the dress ring, and at least the guide ring or the carrier are held by being coupled to a lower brim of the head body via a diaphragm, sealing the hollow of the head body; the back plate is mounted on the dress ring via the diaphragm so that the hollow of the head body is separated into two chambers; the diaphragm is deformed elastically between the dress ring and the carrier during polishing by adjusting pressure of a lower chamber with a mechanism communicating with the lower chamber for adjusting pressing force of the wafer so as to adjust the pressing force of the wafer held by the carrier against the polishing pad; the wafer is polished while the diaphragm is deformed elastically by adjusting pressure of the sealed hollow with a pressure regulating mechanism so as to press with a given pressing force the wafer and the dress ring against the polishing pad on the turn table, the wafer held by the carrier and the dress ring are rotated, and the pressure regulating mechanism communicates with the hollow.

2. The polishing head according to claim 1, wherein a backing pad is provided to the surface of the carrier holding the back surface of the wafer.

3. The polishing head according to claim 2, wherein the carrier is a ceramic plate.

4. The polishing head according to claim 2, wherein the carrier is a flexible film; the polishing head further comprises a retaining plate with a through-hole for retaining the flexible film, the sucking mechanism and a mechanism of adjusting pressing force that communicate with the through-hole of the retaining plate.

5. The polishing head according to claim 1, wherein the carrier is a ceramic plate.

6. The polishing head according to claim 1, wherein the carrier is a flexible film; the polishing head further comprises a retaining plate with a through-hole for retaining the flexible film, the sucking mechanism and a mechanism of adjusting pressing force that communicate with the through-hole of the retaining plate.

7. A polishing apparatus used for polishing a surface of a semiconductor wafer at least comprising: a polishing pad attached on a turn table; a mechanism of providing a polishing agent to the polishing pad; and a polishing head for holding the semiconductor wafer, which is the polishing head according to claim 6.

8. A method for polishing a surface of a semiconductor wafer wherein, the surface is polished by holding the wafer with the polishing head according to claim 6, while the diaphragm is deformed elastically by adjusting pressure of the sealed hollow of the head body with a pressure regulating mechanism so as to press with a given pressing force the wafer and the dress ring against the polishing pad on the turn table, the wafer held by the carrier and the dress ring are rotated, and the pressure regulating mechanism communicates with the hollow.

9. A polishing apparatus used for polishing a surface of a semiconductor wafer at least comprising: a polishing pad attached on a turn table; a mechanism of providing a polishing agent to the polishing pad; and a polishing head for holding the semiconductor wafer, which is the polishing head according to claim 1.

10. A method for polishing a surface of a semiconductor wafer wherein, the surface is polished by holding the wafer with the polishing head according to claim 1, while the diaphragm is deformed elastically by adjusting pressure of the sealed hollow of the head body with a pressure regulating mechanism so as to press with a given pressing force the wafer and the dress ring against the polishing pad on the turn table, the wafer held by the carrier and the dress ring are rotated, and the pressure regulating mechanism communicates with the hollow.

* * * * *